US012781315B2

(12) United States Patent
Yano

(10) Patent No.: US 12,781,315 B2
(45) Date of Patent: Nov. 3, 2026

(54) cBN SINTERED COMPACT

(71) Applicant: MITSUBISHI MATERIALS CORPORATION, Tokyo (JP)

(72) Inventor: Masahiro Yano, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 623 days.

(21) Appl. No.: 18/263,245

(22) PCT Filed: Jan. 24, 2022

(86) PCT No.: PCT/JP2022/002411
§ 371 (c)(1),
(2) Date: Jul. 27, 2023

(87) PCT Pub. No.: WO2022/163572
PCT Pub. Date: Aug. 4, 2022

(65) Prior Publication Data

US 2024/0102135 A1 Mar. 28, 2024

(30) Foreign Application Priority Data

Jan. 30, 2021 (JP) ..... 2021-014037

(51) Int. Cl.
*C22C 26/00* (2006.01)

(52) U.S. Cl.
CPC ..... *C22C 26/00* (2013.01); *C22C 2026/005* (2013.01); *C22C 2026/007* (2013.01); *C22C 2026/008* (2013.01)

(58) Field of Classification Search
CPC ..... C04B 2235/3856; C04B 2235/386; C04B 2235/3873; C04B 2235/80; C04B 35/5831
See application file for complete search history.

(56) References Cited

U.S. PATENT DOCUMENTS 4,343,651 A 8/1982 Yazu et al.
4,788,166 A 11/1988 Araki et al.
(Continued)

FOREIGN PATENT DOCUMENTS

DE 69903242 T2 9/2003
EP 1074530 A2 2/2001
(Continued)

OTHER PUBLICATIONS

International Search Report mailed Mar. 29, 2022 for the corresponding PCT International Patent Application No. PCT/JP2022/002411 (5 pages including English translation).
(Continued)

*Primary Examiner* — Cameron K Miller
(74) *Attorney, Agent, or Firm* — Leason Ellis LLP; Melvin C. Garner; Mitsuhiro Haraguchi

(57) ABSTRACT

A cBN sintered compact includes a binder phase that contains a Ti—Al alloy containing at least one of the Si, Mg, and Zn elements, $Ti_2CN$, $TiB_2$, AlN, and $Al_2O_3$; the ratio $I_{Ti2CN}/I_{TiAl}$ is 2.0 or more and 30.0 or less, wherein $I_{Ti2CN}$ represents the intensity of the $Ti_2CN$ peak appearing at 2θ from 41.9° to 42.2° and $I_{TiAl}$ represents the intensity of the Ti—Al alloy peak appearing at 2θ from 39.0° to 39.3° in XRD; and, in the mapped image of each element of Ti, Al, Si, Mg, and Zn by Auger electron spectroscopy, the ratio $S_{TiAlM}/S_{TiAl}$, is 0.05 or more and 0.98 or less wherein $S_{TiAlM}$ represents the average area of the portions wherein Ti, Al and at least one selected from the group consisting of Si, Mg, and Zn overlap and $S_{TiAl}$ represents the average area of the portions where Ti and Al overlap.

1 Claim, 1 Drawing Sheet

(56) References Cited

U.S. PATENT DOCUMENTS

| | | | |
|---|---|---|---|
| 6,001,757 | A | 12/1999 | Fukaya et al. |
| 6,265,337 | B1 | 7/2001 | Kukino et al. |
| 6,331,497 | B1 | 12/2001 | Collier et al. |
| 2007/0032369 | A1 | 2/2007 | Franzen |
| 2012/0055099 | A1 | 3/2012 | Bao et al. |
| 2017/0101346 | A1 | 4/2017 | Yumoto et al. |
| 2019/0111495 | A1* | 4/2019 | Maekawa ..... C23C 14/0641 |

FOREIGN PATENT DOCUMENTS

| | | | |
|---|---|---|---|
| EP | 1074530 | A3 | 2/2001 |
| JP | 5389809 | B2 | 8/1978 |
| JP | 56156738 | A | 12/1981 |
| JP | 61146763 | A | 7/1986 |
| JP | 05310474 | A | 11/1993 |
| JP | 7172919 | A | 11/1995 |
| JP | 10114575 | A | 5/1998 |
| JP | 2013537116 | A | 9/2013 |
| WO | 2006046124 | A1 | 5/2006 |

OTHER PUBLICATIONS

Japanese Office Action dated Jun. 23, 2025 for the corresponding Japanese Patent Application No. 2022-578360; total 8 pages including English translation.

* cited by examiner cBN SINTERED COMPACT

CROSS-REFERENCE TO RELATED PATENT APPLICATIONS

This application is a U.S. National Phase Application under 35 U.S.C. § 371 of International Patent Application No. PCT/JP2022/002411 filed on Jan. 24, 2022 and claims the benefit of priority to Japanese Patent Application No. 2021-014037 filed on Jan. 30, 2021, the contents of all of which are incorporated herein by reference in their entireties. The International Application was published in Japanese on Aug. 4, 2022 as International Publication No. WO/2022/163572 under PCT Article 21(2).

FIELD OF THE INVENTION

The present invention relates to a cubic boron nitride sintered compact (hereinafter also may be referred to as a cBN sintered compact), which is a hard composite material.

BACKGROUND OF THE INVENTION

WC-based cemented carbide, which has high hardness and excellent toughness, has been used not only in cutting tools but also in drilling tips for drilling tools. cBN sintered compacts, which have low reactivity with Fe-based and Ni-based materials, have also been used in drilling tips for drilling tools in iron and nickel mines, despite inferior hardness compared to diamond.

Drilling tools are tools used for digging in the ground or rocks. Underground rocks are brittle materials with non-uniformity compositions and strength. Unlike cutting processes, which focus on the performance of cutting and scraping, drilling tools must withstand impacts and vibrations to break rocks, and the rotation to efficiently remove the broken rock pieces. Under these circumstances, several proposals have been made to improve the cutting performance and drilling performance of cemented carbide and cBN sintered compact.

For example, Japanese Unexamined Patent Application Publication No. Sho 53-89809 discloses cemented carbide for cutting edges of tools for high depth drilling including ferrous metals, WC, TiC, and TiCN. This cemented carbide exhibits superior wear resistance and corrosion resistance at high temperature.

Japanese Unexamined Patent Application Publication No. Hei 5-310474 discloses a cBN sintered compact to be used for cutting tools or wear-resistant tools, in which the surface of a binder phase forming material of $Ti_2AlC$ is activated to facilitate the reaction between the cBN and the binder phase, thereby forming a second layer including a first layer containing titanium and boron on the surface of each cBN grains and a second layer containing aluminum and boron on the entire surface of the first layer for enhancing the adhesion between the cBN and the binder phase and improving the strength and toughness of the sinter.

Japanese Unexamined Patent Application Publication No. 2013-537116 discloses a self-sintered polycrystalline cubic boron nitride compact including a first phase of cBN grains and a ceramic binder phase containing a titanium compound, wherein the first phase accounts for more than 80% by volume of the boron compact and the binder precursor is $Ti_2AlC$. Since the compact contains a binder phase with electrical conductivity or semi-conductivity, and thus the cBN sintered compact has excellent machinability in electric discharge machining. The cBN sintered compact is suitable for cutting of cast iron and cemented carbide.

CITATION LIST

Patent Literature

[PTL 1] Japanese Unexamined Patent Application Publication No. Sho 53-89809

[PTL 2] Japanese Unexamined Patent Application Publication No. Hei 5-310474

[PTL 3] Japanese Unexamined Patent Application Publication No. 2013-537116

Technical Problem

The present invention was made in view of the aforementioned circumstances and disclosures. The objective of the present invention is to provide a cBN sintered compact that is a hard composite material having excellent fatigue wear resistance and abrasive wear resistance, and also having resistance to damage such as fracture due to impact and vibration applied to destroy a rock, even when the hard composite material is used as a drilling tool.

SUMMARY OF THE INVENTION

Solution to Problem

A cBN sintered compact in accordance with an embodiment of the present invention comprises:

1) cubic boron nitride crystal grains and a binder phase;
2) the binder phase comprises a Ti—Al alloy, $Ti_2CN$, $TiB_2$, AlN, and $Al_2O$, while the Ti—Al alloy containing at least one element selected from the group consisting of Si, Mg, and Zn;
3) the ratio $I_{Ti2CN}/I_{TiAl}$ is 2.0 or more and 30.0 or less, wherein $I_{Ti2CN}$ represents the intensity of the $Ti_2CN$ peak appearing at 2θ from 41.9° to 42.2° and $I_{TiAl}$ represents the intensity of the Ti—Al alloy peak appearing at 2θ from 39.0° to 39.3° in XRD; and
4) in the mapped image of each element of Ti, Al, Si, Mg, and Zn by Auger electron spectroscopy, the ratio $S_{TiAlM}/S_{TiAl}$, is 0.05 or more and 0.98 or less wherein $S_{TiAlM}$ represents the average area of the portions where Ti, Al and at least one selected from the group consisting of Si, Mg, and Zn overlap and $S_{TiAl}$ represents the average area of the portions where Ti and Al overlap.

Advantageous Effects of Invention

The cBN sintered compact is excellent in fatigue wear resistance and abrasive wear resistance, and has resistance to damage factors such as fracture due to impacts and vibrations for breaking rocks in use as a drilling tool.

DETAILED DESCRIPTION OF THE INVENTION

Figure 1:
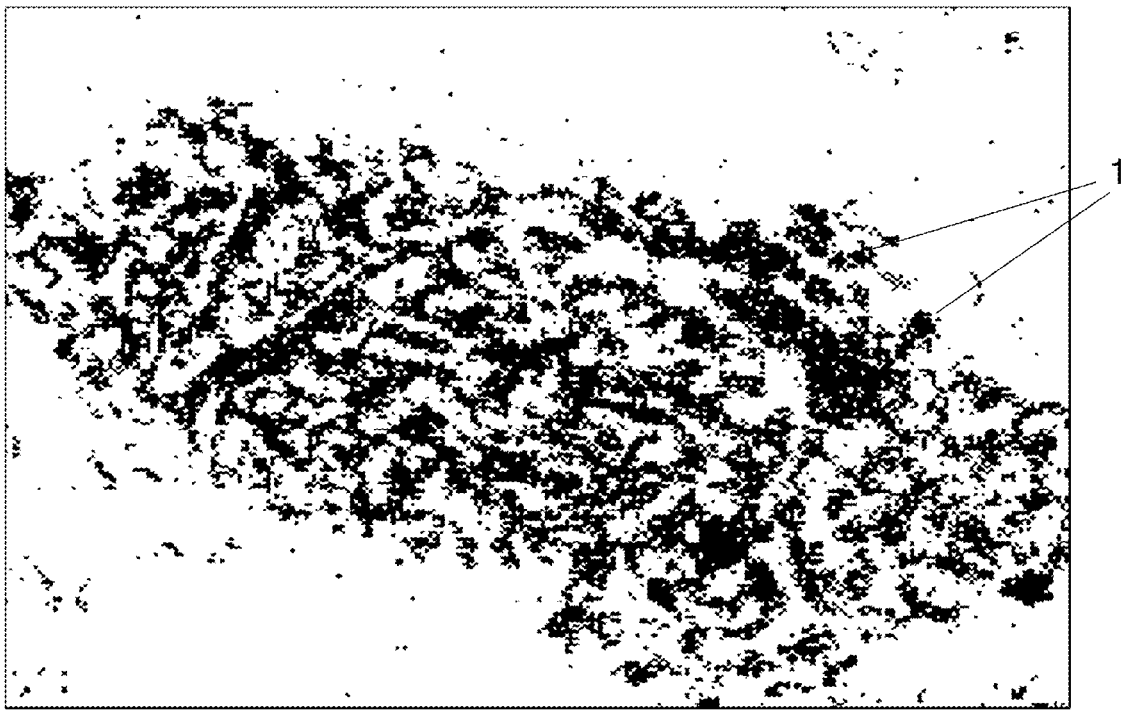
FIG. 1 is a schematic diagram illustrating overlapping portions of the Ti and Al elements based on elemental mapping of Example sintered compact 1 by Auger electron spectroscopy.

The present inventor has focused on cBN sintered compacts as hard composite materials and has extensively studied to produce a cBN sintered compact that has excellent fatigue wear resistance and abrasive wear resistance and is resistant to damaging factors, such as fracture due to impacts and vibrations for breaking rocks in use as a drilling tool.

As a result, the inventor has obtained the knowledge that a predetermined relationship holds between XRD peaks of $Ti_2CN$ and the Ti—Al alloy in the binder phase in the cBN sintered compact, and a Ti—Al alloy containing at least one of Si, Mg, and Zn in the binder phase has excellent fatigue wear resistance and abrasion resistance, and also has resistance to damage factors such as fracture due to impact and vibration in use as a drilling tool.

The following detailed description will focus on application of the cBN compact in accordance with embodiments of the present invention to drilling tools.

The expression "A to B" or "A-B" (A and B are both numerical values) on the numerical range throughout the specification and claims is synonymous with "A or above and B or below", and the range includes the upper limit value (B) and the lower limit value (A). In the case that only the upper limit (B) is followed by a unit, the unit for the upper limit (B) should also be applied to the lower limit (A).

1. Cubic Boron Nitride (cBN) Grains

The average size of cBN grains and the content of cBN grains in the cBN sintered compact will now be described.

(1) Mean Grain Size

The cBN grains used in this embodiment may have any mean grain size. The preferred mean grain size ranges from 0.5 or more to 30.0 or less μm.

The reason for limiting the range of the mean grain size is as follows: In addition to an improvement in fracture resistance by hard cBN grains contained in the sintered compact, a mean grain diameter of 0.5 to 30.0 μm leads to, for example, not only suppressing in breakage and chipping originating from the uneven shape of the cutting edge caused by detachment of cBN grains from the surface of a drilling tool during use, but also suppressing in cracks propagating from the interface between the cBN grains and the binder phase by stresses applied to the cutting edge of the drilling tool during use or suppressing in propagation of cracking of the cBN grains.

The mean diameter of cBN grains can be determined as follows:

The cross section of a sintered cBN is mirror-finished, and the microstructure on the mirror-finished surface is observed by scanning electron microscopy (SEM) to capture a secondary electron image. A portion of cBN grains in the captured image is extracted by image processing, and the mean grain diameter (described below) is calculated based on the maximum length of each grain determined by image analysis.

The extraction of the portions of cBN grains in the image by the image processing comprises the steps of: displaying the image in monochrome of 256 gradations including 0 in black and 255 in white to clearly distinguish the cBN grains from the binder phase; and binarizing the image using a threshold calculated with an expression $(w-v)/2+v$ where v represents the peak pixel value of each portion of cBN grains and w represents the peak pixel value of each portion of the binder phases.

It is preferable to determine pixel values of at least three different cBN grains within the same image area and to define the average of the three pixel values as the peak pixel value of the cBN grain. The region for determining the pixel values of each cBN grain has dimensions of, for example, about 0.5 μm by 0.5 μm. It is preferable to determine pixel values of at least three different binder phases within the same image area and to define the average of the three pixel values as the peak value of the binder phase. The region for determining the pixel values of each binder phase has dimensions of about 0.2 μm by 0.2 μm to 0.5 μm by 0.5 μm.

After the binarization process, the cBN grains are separated from each other by a process that separates the contact portions of the cBN grains, for example, by watershed analysis.

The black portions corresponding to cBN grains in the image after the binarization process are subjected to grain analysis, and the maximum length of each cBN grain is defined as a diameter of the grain. For grain analysis to determine the maximum length, a larger one of the two lengths obtained by calculating the Feret diameter of one cBN grain is a maximum length, and this value is defined as a diameter of each cBN grain.

Each cBN grain is then assumed to be an ideal sphere with this diameter, to calculate the cumulative volume as a volume of the grain. Based on this cumulative volume, a graph is drawn with the vertical axis as volume percentage (%) and the horizontal axis as diameter (μm). The diameter at 50% volume fraction corresponds to the mean diameter of cBN grains. This treatment is performed for three observation areas, and the mean thereof is defined as a mean grain diameter D50 of cBN (μm).

Prior to the grain analysis, a length (μm) per pixel is preliminarily determined with a standard scale in a SEM image. Preferably, at least 30 cBN grains are observed in an observation area. For example, in the case that the average size of the cBN grains is about 3 μm, the observation area is preferably about 15 μm by 15 μm.

(2) Content

The cBN compact may contain any amount (% by volume) of cBN grains. A preferred content range between 65.0% by volume or more and 93.0% by volume or less for the following reasons.

A content below 65.0% by volume leads to a reduced amount of hard material (cBN grains) in the cBN sintered compact, which may result in reduced fracture resistance in use, for example, as a drilling tool. A content above 93.0% by volume leads to formation of voids in the cBN sintered compact, which voids may work as origins of cracks and thus may result in reduced fracture resistance.

The content of the cBN grains in the cBN sintered compact can be determined as follows: A cross-sectional microstructure of the cBN sintered compact is observed by SEM, the portions of cBN grains in the observed secondary electron image are extracted by image processing, and then the area occupied by the cBN grains is calculated by image analysis. This procedure is repeated in at least three observation regions, and the average of the resulting areas is defined as a cBN grain content (% by volume). Preferably, at least 30 cBN grains are observed in an observation area. For example, in the case that the average size of the cBN grains is about 3 μm, the observation area is preferably about 15 μm by 15 μm.

2. Binder Phase

The binder phase of the present embodiment preferably contains $Ti_2CN$, $TiB_2$, AlN and $Al_2O_3$ in addition to a Ti—Al alloy containing at least one selected from the group consisting of Si, Mg, and Zn.

At least one selected from the group consisting of Si, Mg and Zn includes any one, any two, and any three (all) of the Si, Mg, and Zn elements.

It is preferable that the XRD peak intensities of $Ti_2CN$ and the Ti—Al alloy contained in the binder phase have a predetermined relation. Specifically, the ratio $I_{Ti2CN}/I_{TiAl}$ of the peak intensities is preferably 2.0 or more and 30.0 or less where $I_{Ti2CN}$ represents the intensity of the $Ti_2CN$ peak appearing at 2θ of 41.9° to 42.2° in XRD and $I_{TiAl}$ represents the intensity of the Ti—Al alloy peak appearing at 2θ of 39.0° to 39.3°. At a ratio of peak intensities within this range, the resulting cBN sintered compact has excellent wear resistance and abrasive wear resistance, and is highly resistant to damage factors such as chipping due to impact and vibration during rock excavation, for the following reasons.

At a ratio $I_{Ti2CN}/I_{TiAl}$ of less than 2.0, an excess amount of Ti—Al alloy present in the cBN sintered compact causes cBN grains to react with the Ti—Al alloy to form coarse $TiB_2$ and causes an excess amount of AlN to be formed. The $TiB_2$ and AlN work as starting points for fracture during rock excavation, for example. At a ratio $I_{Ti2CN}/I_{TiAl}$ of greater than 30.0, the content of Ti—Al alloy in the cBN sintered compact decreases, resulting in reductions in adhesion between the cBN grains and the binder phase and toughness of the cBN sintered compact.

The peak intensity $I_{Ti2CN}$ of $Ti_2CN$ and the peak intensity $I_{TiAl}$ of the Ti—Al alloy were determined by XRD using CuKα rays, where the peak of the (111) diffraction line of cBN at 2θ=43.3 is defined as a standard peak, the peak between 41.9° and 42.2° at 2θ angle is defined as $Ti_2CN$, and the peak between 39.0° and 39.3° at 2θ angle is defined as Ti—Al alloy. After background noise removal, these peaks are confirmed through peak search.

One or more elements of the Si, Mg, and Zn elements are dispersed together in the Ti—Al alloy in the binder phase. In the mapping image by Auger electron spectroscopy (hereinafter AES) of the Ti, Al, Si, Mg, and Zn elements, the ratio $S_{TiAlM}/S_{TiAl}$ preferably ranges from 0.05 to 0.98, where $S_{TiAlM}$ represents the average area where one or more elements of the Ti and Al elements and one or more elements of the Si, Mg, and Zn elements overlap with each other and $S_{TiAl}$ represents the average area where the Ti and Al elements overlap with each other.

The observation area by AES is preferably about 15 μm by 15 μm.

Figure 2:
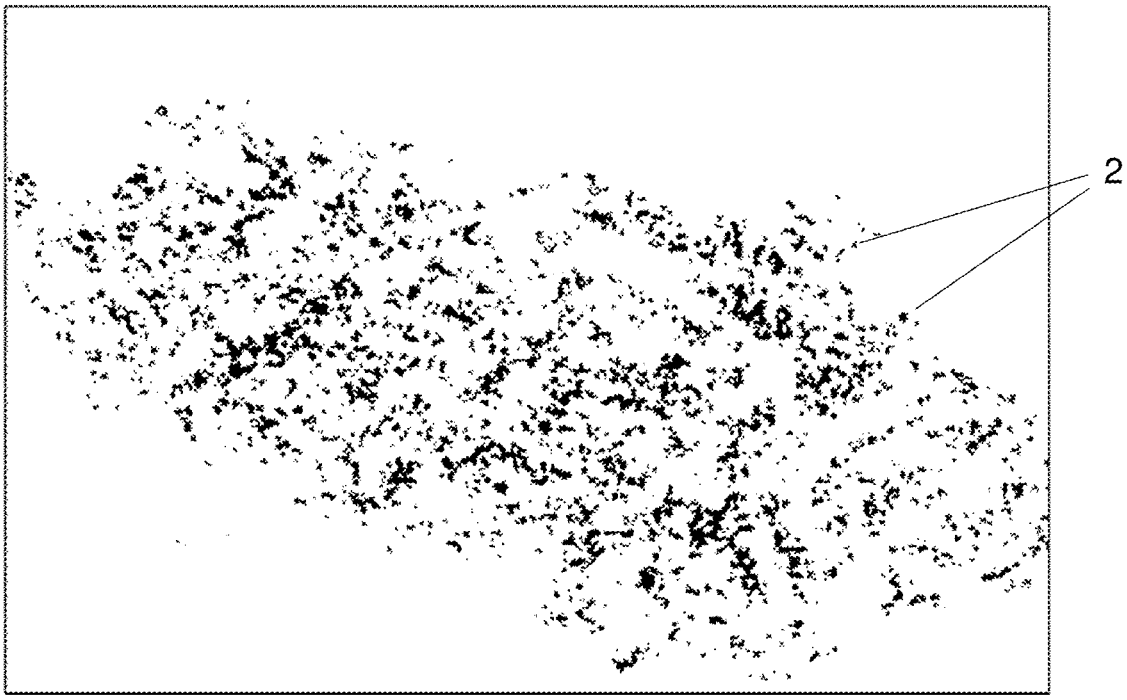
FIG. 2 is a schematic diagram illustrating overlapping portions of the Ti, Al, and Si elements based on elemental mapping of Example sintered compact 1 by Auger electron spectroscopy.

As examples of elemental mapping Example sintered compact 1 (will be described later) by AES, FIG. 1 illustrates portions where the Ti and Al elements overlap with each other 1 (indicated by black dots), while FIG. 2 illustrates portions where the Ti, Al, and Si elements overlap with each other 2 (indicated by black dots). In comparison of these drawings, the overlapping portions 2 in FIG. 2 are distinctly parts of the overlapping portions 1 in FIG. 1.

Although the reason why the presence of one or more elements of the Si, Mg, and Zn elements together with the Ti—Al alloy reduces the fatigue fracture is not clear, it is speculated as follows.

The reaction of $TiAl_3$ with cBN involves decomposition of $TiAl_3$ and generates AlN and $TiB_2$. The resulting AlN has low strength, and readily functions as a starting point of fracture caused by the impact applied in use of a drilling tool of the cBN sintered compact. Since one or more elements of the Si, Mg, and Zn elements are present as constituent raw materials of the binder phase, Al generated by the decomposition of $TiAl_3$ reacts with a compound containing Si, Mg, and Zn elements to form $Al_2O_3$ and to reduce the formation of AlN. In addition, the Ti—Al alloy, which is produced by the decomposition of $TiAl_3$ and contains one or more elements of Si, Mg, and Zn elements, probably improves the wear resistance.

The reason why the ratio $S_{TiAlM}/S_{TiAl}$ preferably falls within the above range is as follows. At a ratio of less than 0.05, a large amount of AlN is generated in the cBN sintered compact to facilitate fatigue fracture, and a large AlN is present in the cBN sintered compact to facilitate propagation of cracking generated in the sintered compact. At a ratio exceeding 0.98, the formation of AlN is suppressed, but $Al_2O_3$ and TiCNO are abundant in the binder phase due to oxygen originating in the raw material. TiCNO works as a start point of fatigue fracture and thus decreases the toughness of the sintered compact.

The above description includes the features appended below.

APPENDIX 1

A cBN sintered compact comprising:

cubic boron nitride crystal grains and a binder phase; wherein 1) the binder phase comprises a Ti—Al alloy containing at least one selected from the group consisting of Si, Mg, and Zn, and further comprises $Ti_2CN$, $TiB_2$, AlN, and $Al_2O_3$;
2) the ratio $I_{Ti2CN}/I_{TiAl}$ is 2.0 or more and 30.0 or less, wherein $I_{Ti2CN}$ represents the intensity of the $Ti_2CN$ peak appearing at 2θ from 41.9° to 42.2° and $I_{TiAl}$ represents the intensity of the Ti—Al alloy peak appearing at 2θ from 39.0° to 39.3° in XRD; and
3) in the mapped image of each element of Ti, Al, Si, Mg, and Zn by Auger electron spectroscopy, the ratio $S_{TiAlM}/S_{TiAl}$, is 0.05 or more and 0.98 or less wherein $S_{TiAlM}$ represents the average area of the portions where Ti, Al and at least one selected from the group consisting of Si, Mg, and Zn overlap and $S_{TiAl}$ represents the average area of the portions where Ti and Al overlap.

APPENDIX 2

The cBN sintered compact described in Appendix 1, wherein the cubic boron nitride crystal grains have an average grain size of 0.5 μm or more and 30.0 μm or less.

APPENDIX 3

The cBN sintered compact described in Appendix 1 or 2, wherein the content of the cubic boron nitride crystal grains is 65% by volume or more and 93.0% by volume or less.

EXAMPLES

Examples will now be described. It should be noted that the present invention is not limited to examples applied to tools for cutting rock.

The samples of the examples were manufactured by the following steps (1) to (3). The raw material powders contained trace amounts of inevitable impurities.

(1) Preparation of Raw Material Powders

Hard material, i.e., cBN raw material that had a mean grain size of 0.5 to 35.0 μm after sintering as shown in Table 2, and binder phase material, $Ti_2AlC$ and $Ti_3AlC_2$ were prepared. Both $Ti_2AlC$ and $Ti_3AlC_2$ raw powder had a mean grain size of 50 μm.

TiN powder (0.6), TiCN powder (0.6), TiC powder (0.6), $TiAl_3$ powder (0.4), and $SiO_2$ powder (0.02), $Si_3N_4$ powder (0.02), $MgSiO_3$ powder (0.8), ZnO powder (0.8), and MgO powder (0.8) as raw material were also prepared for forming binder phases, where the number in parentheses after the name of each powder represents the mean grain size (D50) in μm. Table 1 shows the composition of these raw materials.

(2) Mixing and Presintering Treatment

Raw powders other than powders containing Si, Mg, or Zn elements were placed together with cemented carbide alloy balls and acetone into a ball mill vessel lined with a cemented carbide. The mixing time was 1 hour so as not to pulverize the raw material powder mixture. Although not performed in these examples, it is more preferable that the raw material powders are mixed while agglomerates are disintegrated with an ultrasonic stirrer.

The mixed raw material powder was preliminarily presintered at a temperature described on the column "Heat treatment temperature after mixing" in Table 2 under a vacuum atmosphere of 1 Pa or less to evaporate the adsorbed water from the powder surfaces.

It is preferred that the presintering temperature be 250 to 900° C. under a vacuum atmosphere of 1 Pa or less for the following reasons: At a temperature of less than 250° C., the evaporation of the adsorbed water is insufficient and thus $Ti_2AlC$ and $Ti_3AlC_2$ react with the remaining moisture to form decomposed $TiO_2$ and $Al_2O_3$ during ultra-high pressure and high temperature sintering. At a temperature exceeding 900° C., $Ti_2AlC$ and $Ti_3AlC_2$ react with oxygen to form decomposed $TiO_2$ and $Al_2O_3$ during the presintering treatment. Both cases causes the contents of $Ti_2AlC$ and $Ti_3AlC_2$ in the binder phase to decrease and the toughness of the cBN sintered compact to decrease.

Presintered powders other than powders containing the Si, Mg, or Zn element and one or more of the $SiO_2$, $Si_3N_4$, $MgSiO_3$, ZnO, and MgO powders were placed together with cemented carbide balls and acetone into a ball mill vessel lined with a cemented carbide and mixed. The mixing time was 1 hour so as not to pulverize the raw material powder. Although not performed in these examples, it is more preferable that the raw material powders are mixed while agglomerates are disintegrated with an ultrasonic stirrer.

(3) Molding and Sintering

Green compacts were produced from the resulting sintered raw material powder, were placed into an ultrahigh pressure and high temperature sintering apparatus, and then were sintered at a pressure of 5 GPa and a temperature of 1600° C. to form cBN sintered compacts 1 to 23 of the present invention (referred to as sintered compacts of Examples). Each value in Table 2 was measured by the methods described above. The average grain size and content of the cBN grains were measured in an observation area containing at least 30 cBN observable grains, and the other observation areas were determined as already stated.

Comparative sintered compacts were also produced for comparison. As raw material for hard material, i.e., cBN raw material that had a mean grain size of 1.0 to 4.0 μm after sintering as shown in Table 4, and binder phase material, $Ti_2AlC$ or $Ti_3AlC_2$ were prepared. Both $Ti_2AlC$ and $Ti_3AlC_2$ raw powder had a mean grain size (D50) of 50 μm (the other powders had the same average grain size as that in Examples). These were blended so as to have compositions shown in Tables 1 and 3, and were mixed by a ball mill as in Examples. Each mixture was presintered at a predetermined temperature (described on the column "Heat treatment temperature after mixing" in Table 4) in the range of 100° C. to 1200° C. in a vacuum atmosphere of 1 Pa or less, and then was molded to prepare a green compact, which was then charged into an ultra-high pressure and high temperature sintering apparatus, and was sintered at a pressure of 5 GPa and a temperature of 1600° C. cBN sintered compacts of comparative examples 1 to 9 (referred to as comparative sintered compacts) shown in Table 4 were thereby prepared. Each value in Table 4 was determined as in examples.

TABLE 1

| Type | | Composition (% by volume) | | | | | | | | | | |
|---|---|---|---|---|---|---|---|---|---|---|---|---|
| | | $Ti_2AlC$ | $Ti_3AlC_2$ | TiN | TiCN | TiC | $TiAl_3$ | $SiO_2$ | $Si_3N_4$ | $MgSiO_3$ | ZnO | MgO |
| Raw | a | 98 | — | — | — | — | — | 2 | — | — | — | — |
| material | b | — | 98 | — | — | — | — | — | 2 | — | — | — |
| of binder | c | 95 | — | — | — | — | — | — | — | 5 | — | — |
| phae for | d | — | 90 | — | — | — | — | — | — | — | 10 | — |
| Example* | e | | 80 | — | — | — | — | — | — | — | — | 20 |
| | f | — | 99 | — | — | — | — | 1 | — | — | — | — |
| | g | — | 85 | — | — | — | — | 15 | — | — | — | — |
| | h | — | 85 | — | — | — | — | — | 15 | — | — | — |
| | i | — | 75 | — | — | — | — | — | — | — | — | 25 |
| | j | 85 | — | — | — | — | — | — | — | 10 | 5 | — |
| | k | 75 | — | — | 19 | — | 4 | — | — | 2 | — | — |
| | l | 80 | — | 3 | — | 15 | — | 2 | — | — | — | — |
| | m | 80 | — | — | 15 | — | — | — | — | — | 5 | — |
| | n | 80 | — | 15 | — | — | — | — | — | 5 | — | — |
| | o | 80 | — | — | — | — | 18 | 2 | — | — | — | — |

In Table 1, the symbol "-" indicates not containing, "*" represents that part of the material was used as a binder phase material for comparison.

TABLE 2

| Type | | CBN Content (% by volume) | CBN Average grain size (μm) | Material for binder phase | Heat treatment temperature after mixing (° C) | Ratio of peak intensities by XRD $I_{Ti2CN}/I_{Ti—Al}$ | $S_{TiAlM}/S_{TiAl}$ | Identi-faction of Si, Zn, and Mg elements by AES | Composition of sintered compact (identified by XRD) |
|---|---|---|---|---|---|---|---|---|---|
| Sintered compact of example | 1 | 74.8 | 2.5 | g | 600 | 10.2 | 0.29 | Identified | cBN, $Ti_2CN$, $TiB_2$, $TiAl_3$, AlN ($Al_2O_3$ peak not found*) |
| | 2 | 75.1 | 2.7 | k | 650 | 11.4 | 0.06 | Identified | cBN, $Ti_2CN$, TiC, $TiB_2$, $TiAl_3$, $Al_2O_3$, AlN |
| | 3 | 75.1 | 2.8 | b | 650 | 10.5 | 0.24 | Identified | cBN, $Ti_2CN$, $TiB_2$, $TiAl_3$, AlN ($Al_2O_3$ peak not found*) |
| | 4 | 86.5 | 2.8 | a | 650 | 10.1 | 0.16 | Identified | cBN, $Ti_2CN$, $TiB_2$, $TiAl_3$, $Al_2O_3$, AlN |
| | 5 | 69.7 | 1.4 | o | 350 | 2.5 | 0.12 | Identified | cBN, $Ti_2CN$, $TiB_2$, $TiAl_3$, $Al_2O_3$, AlN |
| | 6 | 74.6 | 3.1 | d | 650 | 10.1 | 0.30 | Identified | cBN, $Ti_2CN$, $TiB_2$, $TiAl_3$, AlN ($Al_2O_3$ peak not found*) |
| | 7 | 92.7 | 2.2 | a | 650 | 10.1 | 0.14 | Identified | cBN, $Ti_2CN$, $TiB_2$, $TiAl_3$, $Al_2O_3$, AlN |
| | 8 | 75.2 | 2.4 | m | 900 | 22.9 | 0.20 | Identified | cBN, $Ti_2CN$, $TiB_2$, $TiAl_3$, $Al_2O_3$, AlN |
| | 9 | 76.1 | 2.3 | f | 600 | 10.7 | 0.05 | Identified | cBN, $Ti_2CN$, $TiB_2$, $TiAl_3$, AlN ($Al_2O_3$ peak not found*) |
| | 10 | 76.3 | 2.1 | m | 450 | 30.0 | 0.23 | Identified | cBN, $Ti_2CN$, $TiB_2$, $TiAl_3$, $Al_2O_3$, AlN |
| | 11 | 75.1 | 2.7 | o | 250 | 2.0 | 0.11 | Identified | cBN, $Ti_2CN$, $TiB_2$, $TiAl_3$, $Al_2O_3$, AlN |
| | 12 | 76.5 | 2.6 | c | 600 | 11.5 | 0.26 | Identified | cBN, $Ti_2CN$, $TiB_2$, $TiAl_3$, $Al_2O_3$, AlN |
| | 13 | 75.9 | 2.1 | a | 650 | 12.1 | 0.15 | Identified | cBN, $Ti_2CN$, $TiB_2$, $TiAl_3$, $Al_2O_3$, AlN |
| | 14 | 70.9 | 19.8 | b | 800 | 9.4 | 0.21 | Identified | cBN, $Ti_2CN$, $TiB_2$, $TiAl_3$, AlN ($Al_2O_3$ peak not found*) |
| | 15 | 75.6 | 2.2 | j | 650 | 12.7 | 0.45 | Identified | cBN, $Ti_2CN$, $TiB_2$, $TiAl_3$, $Al_2O_3$, AlN |
| | 16 | 68.1 | 30.0 | a | 650 | 8.7 | 0.17 | Identified | cBN, $Ti_2CN$, $TiB_2$, $TiAl_3$, $Al_2O_3$, AlN |
| | 17 | 75.3 | 2.7 | h | 600 | 10.3 | 0.89 | Identified | cBN, $Ti_2CN$, $TiB_2$, $TiAl_3$, AlN ($Al_2O_3$ peak not found*) |
| | 18 | 75.8 | 0.5 | l | 800 | 12.8 | 0.16 | Identified | cBN, $Ti_2CN$, TiC, $TiB_2$, $TiAl_3$, $Al_2O_3$, AlN |
| | 19 | 74.9 | 7.9 | n | 650 | 15.8 | 0.14 | Identified | cBN, $Ti_2CN$, TiC, $TiB_2$, $TiAl_3$, $Al_2O_3$, AlN |
| | 20 | 76.2 | 2.6 | e | 600 | 9.7 | 0.65 | Identified | cBN, $Ti_2CN$, $TiB_2$, $TiAl_3$, AlN ($Al_2O_3$ peak not found*) |
| | 21 | 74.9 | 2.3 | i | 600 | 9.6 | 0.98 | Identified | cBN, $Ti_2CN$, $TiB_2$, $TiAl_3$, AlN ($Al_2O_3$ peak not found*) |
| | 22 | 76.2 | 14.9 | a | 900 | 12.3 | 0.14 | Identified | cBN, $Ti_2CN$, $TiB_2$, $TiAl_3$, $Al_2O_3$, AlN |
| | 23 | 74.9 | 2.5 | o | 650 | 4.9 | 0.13 | Identified | cBN, $Ti_2CN$, $TiB_2$, $TiAl_3$, $Al_2O_3$, AlN |

In Table 2, the symbol * indicates that $Al_2O_3$ was identified with an electron probe micro analyzer (EPMA).

TABLE 3

| Type | | Composition (% by volume) $Ti_2AlC$ | $Ti_3AlC_2$ | TiCN | $TiAl_3$ | $SiO_2$ | $MgSiO_3$ |
|---|---|---|---|---|---|---|---|
| Raw material of binder phae for Comparative example | p | — | 35 | — | 15 | 50 | — |
| | q | — | 35 | — | 50 | 15 | — |
| | r | 35 | — | 60 | 5 | — | — |
| | s | — | 40 | 45 | 5 | — | 10 |
| | t | — | 25 | 30 | 5 | — | 40 |
| | u | 35 | — | — | 55 | — | 10 |
| | v | 40 | — | — | 59.5 | 0.5 | — |

In Table 3, the symbol "-" indicates not containing,

TABLE 4

| Type | | cBN Content (% by volume) | cBN Average grain size (μm) | Material for binder phase | Heat treatment temperature after mixing (° C) | Ratio of peak intensities by XRD $I_{Ti2CN}/I_{Ti—Al}$ | $S_{TiAlM}/S_{TiAl}$ | Identi-faction of Si, Zn, and Mg elements by AES | Composition of sintered compact (Identified by XRD) |
|---|---|---|---|---|---|---|---|---|---|
| Sintered compact of compar-ative example | 1 | 74.9 | 2.1 | s | 650 | 57.9 | 0.49 | Identified | cBN, $Ti_2CN$, $TiB_2$, $TiAl_3$, AlN ($Al_2O_3$ peak not found*[2]) |
| | 2 | 74.1 | 2.4 | p | 650 | 0.5 | 1.00 | Identified | cBN, $Ti_2CN$, $TiB_2$, $TiAl_3$, $Al_2O_3$, AlN |
| | 3 | 75.7 | 2.5 | s | 100 | 42.7 | 0.53 | Identified | cBN, $Ti_2CN$, $TiB_2$, $TiAl_3$, AlN ($Al_2O_3$ peak not found*[2]) |
| | 4 | 76.0 | 2.2 | q | 650 | 0.5 | 0.41 | Identified | cBN, $Ti_2CN$, $TiB_2$, $TiAl_3$, $Al_2O_3$, AlN |
| | 5 | 75.9 | 2.6 | v | 650 | 0.5 | 0.01 | Identified | cBN, $Ti_2CN$, $TiB_2$, $TiAl_3$, $Al_2O_3$, AlN |
| | 6 | 75.5 | 2.5 | t | 650 | 40.2 | 1.00 | Identified | cBN, $Ti_2CN$, $TiB_2$, $TiAl_3$, AlN ($Al_2O_3$ peak not found*[2]) |
| | 7 | 74.8 | 2.2 | u | 650 | 0.4 | 0.48 | Identified | cBN, $Ti_2CN$, $TiB_2$, $TiAl_3$, $Al_2O_3$, AlN |
| | 8 | 76.3 | 2.3 | r | 650 | 59.7 | 0.00 | Not identified | cBN, $Ti_2CN$, $TiB_2$, $TiAl_3$, $Al_2O_3$, AlN |
| | 9 | 75.7 | 2.6 | c | 1200 | —*[1] | 0.23 | Identified | cBN, $Ti_2CN$, $TiB_2$, $TiAl_3$, $Al_2O_3$, AlN |

In Table 4, the symbol "*1" indicates that no XRD peak assigned to $TiAl_3$ was found, and the symbol "*2" indicates that $Al_2O_3$ was identified with an electron probe micro analyzer (EPMA).

Example tools 1 to 23 (referred to as Examples 1 to 23) and Comparative example tools 1 to 9 (referred to as Comparative examples 1 to 9) each having an ISO standard RNGN090300 geometry were made from Example sintered compacts 1 to 23 and Comparative example sintered compacts 1 to 9, respectively, and each tool was mounted on an NC lathe and the following wet cutting test was conducted.

Cutting speed: 150 m/min

Depth of cut: 0.3 mm

Feed rate: 0.1 mm/rev

Workpiece material to be cut: granite (from Takine), shape Φ150 mm by 200 mm L

Cutting fluid material: water-soluble cutting oil (Neocool by MORESCO Co., Ltd.)

The amount of wear of the cutting edge and the state of the cutting edge were checked after the cutting length (cutting distance) reached 800 m. Regardless of this, the cutting edge was observed every 100 m of cutting length to observe any defect and the amount of wear. If the amount of wear exceeded 2000 μm, the cutting test was stopped at that point. The results are shown in Table 5.

TABLE 5

| Type | | Amount of wear (State of edge) |
|---|---|---|
| Example | 1 | 1960 μm(Chipping observed) |
| | 2 | 1290 μm(Chipping not observed) |
| | 3 | 1510 μm(Chipping not observed) |
| | 4 | 1380 μm(Chipping not observed) |
| | 5 | 2090 μm(Chipping observed) |
| | 6 | 1920 μm(Chipping observed) |
| | 7 | 1310 μm(Chipping not observed) |
| | 8 | 1810 μm(Chipping observed) |
| | 9 | 1820 μm(Chipping observed) |
| | 10 | 1920 μm(Chipping observed) |
| | 11 | 1890 μm(Chipping not observed) |
| | 12 | 1750 μm(Chipping not observed) |
| | 13 | 1610 μm(Chipping not observed) |
| | 14 | 1880 μm(Chipping observed) |
| | 15 | 1900 μm(Chipping not observed) |
| | 16 | 1710 μm(Chipping not observed) |
| | 17 | 2090 μm(Chipping observed) |
| | 18 | 1420 μm(Chipping not observed) |
| | 19 | 1630 μm(Chipping not observed) |
| | 20 | 2000 μm(Chipping observed) |
| | 21 | 2150 μm(Chipping observed) |
| | 22 | 1560 μm(Chipping not observed) |
| | 23 | 1800 μm(Chipping not observed) |
| Comparative example | 1 | Not measured (Fracture)* |
| | 2 | Not measured (Fracture)* |
| | 3 | 2400 μm(Chipping observed)* |
| | 4 | 2600 μm(Chipping observed)* |
| | 5 | 2200 μm(Chipping observed)* |
| | 6 | Not measured (Fracture)* |
| | 7 | 2200 μm(Chipping observed)* |
| | 8 | Not measured (Fracture)* |
| | 9 | Not measured (Fracture)* |

In Table 5, the symbol "*" indicates the state at a cutting length of 100 m.

Table 5 evidentially demonstrates that all Examples show reduced amount of wear and no chipping indicating high abrasive wear resistance, and also are resistant to damage factors, such as fracture due to impacts and vibrations to destroy the rock, even use as drilling tools. In contrast, all Comparative examples experience fracture or a high amount of wear after only a short cutting length, and thus have low abrasion resistance, which results indicate that they are difficult to use as drilling tools.

The disclosed embodiments are illustrative only and not restrictive in all respects. The scope of the invention is indicated by the claims rather than the aforementioned embodiments and is intended to include all modifications within the gist and scope of the claims and equivalents.

REFERENCE SIGNS LIST

1 represents portions where the Ti and Al elements overlap with each other

2 represents portions where the Ti, Al, and Si elements overlap with each other

The invention claimed is:

1. A cBN sintered compact comprising:

cubic boron nitride crystal grains; and a binder phase, wherein 1) the binder phase comprises;

a Ti—Al alloy, $Ti_2CN$, $TiB_2$,

AlN, and $Al_2O_3$, the Ti—Al alloy containing at least one element selected from the group consisting of Si, Mg, and Zn, 2) a ratio $I_{Ti2CN}/I_{TiAl}$ is 2.0 or more and 30.0 or less, where $I_{Ti2CN}$ represents an intensity of the $Ti_2CN$ peak appearing at 2θ from 41.9° to 42.2° and $I_{TiAl}$ represents an intensity of the Ti—Al alloy peak appearing at 2θ from 39.0° to 39.3° in XRD, and 3) in a mapped image of each element of Ti, Al, Si, Mg, and Zn by Auger electron spectroscopy for an observation area about 15 m by 15 am, a ratio $S_{TiAlM}/S_{TiAl}$, is 0.05 or more and 0.98 or less wherein $S_{TiAlM}$ represents an average area of portions where Ti, Al and at least one selected from the group consisting of Si, Mg, and Zn overlap and $S_{TiAl}$ represents an average area of portions where Ti and Al overlap.

* * * * *